US011326415B2

(12) United States Patent
Orbell

(10) Patent No.: US 11,326,415 B2
(45) Date of Patent: May 10, 2022

(54) ROTATING DIVERTER HEAD WITH REMOTE CONTROLLED CLAMPING SYSTEM

(71) Applicant: ADS Services LLC, Midland, TX (US)

(72) Inventor: Charles Orbell, Satellite Beach, FL (US)

(73) Assignee: ADS SERVICES, LLC, Midland, TX (US)

( * ) Notice: Subject to any disclaimer, the term of this patent is extended or adjusted under 35 U.S.C. 154(b) by 0 days.

(21) Appl. No.: 17/084,270

(22) Filed: Oct. 29, 2020

(65) Prior Publication Data

US 2021/0123316 A1 Apr. 29, 2021

Related U.S. Application Data

(60) Provisional application No. 62/927,604, filed on Oct. 29, 2019.

(51) Int. Cl.
*E21B 33/08* (2006.01)
*E21B 21/08* (2006.01)

(52) U.S. Cl.
CPC ..... *E21B 33/085* (2013.01); *E21B 21/08* (2013.01)

(58) Field of Classification Search
CPC ..... E21B 21/08; E21B 33/085
See application file for complete search history.

(56) References Cited

U.S. PATENT DOCUMENTS

2009/0139724 A1* 6/2009 Gray ..... E21B 23/04 166/345
2012/0125633 A1* 5/2012 Linde ..... E21B 33/08 166/381
2020/0040690 A1* 2/2020 Yousef ..... E21B 33/085
2021/0062588 A1* 3/2021 Downie ..... E21B 17/02

* cited by examiner

*Primary Examiner* — James G Sayre

(57) ABSTRACT

A rotating control device is disclosed for the use of oil, gas or geothermal wells. While providing for sealing with or without rotation of the drill pipe, the device consists of a housing with guide rails attached beneath the two part dual actuated clamp that can be locked in place by remote controlled retention pins. The design has a novel adapter design enabling a common RCD bearing assembly to be installed in a variety of different housing sizes.

17 Claims, 6 Drawing Sheets

ROTATING DIVERTER HEAD WITH REMOTE CONTROLLED CLAMPING SYSTEM

CROSS-REFERENCE TO RELATED APPLICATIONS

This application claims benefit of U.S. Provisional Application No. 62/927,604, filed Oct. 29, 2019, entitled TWENTY INCH ROTATING DIVERTER HEAD WITH REMOTE CONTROLLED CLAMPING SYSTEM, which is incorporated by reference herein in its entirety.

TECHNICAL FIELD

This invention relates to the field of fluid drilling equipment, and in particular to rotating diverter heads to be used in the field of fluid drilling equipment.

BACKGROUND

In drilling a well, a drilling tool or "drill bit" is rotated under an axial load with a bore hole. The drill bit is attached to the bottom of a string of threadably connected tubulars or "drill pipe" located in the bore hole. The drill pipe is rotated at the surface of the well by an applied torque which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through annulus between the wall of the bore hole and the drill pipe. Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques.

New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

Rotating diverter heads provide a means of sealing off the annulus around the drill pipe as the drill pipe rotates and translates axially down the well while including a side outlet through which the return drilling fluid is diverted. Such rotating diverter heads may also be referred to as rotating blow out preventers or drilling heads. These units generally comprise a stationary housing or bowl including a side outlet for connection to a fluid return line and an inlet flange for locating the unit on a blow out preventer or other drilling stack at the surface of the well bore. Within the bowl, opposite the inlet flange, is arranged a rotatable assembly such as anti-friction bearings which allow the drill pipe, located through the head, to rotate and slide. The assembly includes a seal onto the drill pipe which is typically made from rubber, polyurethane or other suitable elastomer.

The rotatable assembly usually called "bearing assembly" needs to be removable replacement of the seal commonly referred to as stripper rubber. All prior art designs usually have a bolted retention system for the bearing assembly or some sort of clamp that retains an annular protrusion against a similar protrusion on the top of the bowl. Usually this is a clamshell type clamp as shown in one of the earliest patents by Williams U.S. Pat. No. 3,400,938 which consists of two halves joined with a pivot at one end and some sort of retention mechanism like a bolt or a hydraulic or pneumatic actuator at the other end.

This type of clamp requires considerable movement on the non-pivot side to be able to allow the retaining flange (protrusion) on the bearing assembly to clear. In this disclosure a simpler clamping version is suggested that uses two identical clamp halves that move in a single dimension of direction to open and close. Furthermore, a remote controlled safety latch is introduced that ensures a positive lock to prevent any accidental or unintended release of the clamps under pressure. An interlock mechanism is provided to ensure that the human failure is also removed as a possible release mechanism.

SUMMARY

An RCD (Rotating Control Device) with the newly equipped Dual Actuated Clamp consists of two actuators located on opposing sides of the clamp. Each of the actuators will involve a fully remote controlled Retention Pin connected to the central housing that will be driven into through holes on each end of the clamp thus positively locking it in place irrespective of any pressure drop within the actuation system. The clamp has guide runners located on the underside that allow the clamp to open in a linear motion while maintaining the clamp orientation in the vertical plane. At the bottom of the device and at the side outlet there are flanges with a circular bolt hole patterns both following API (American Petroleum Institute) standard specifications.

Along the surface of the ID (Inner Diameter) of the device and on the side flange there will be seals preventing leakage between the device and connected components. A control panel will be positioned at a safe distance away from the device itself for the use of locking and unlocking the clamp. This control panel will override the retention pin actuation via button actuation, that acts as a secondary safety mechanism, dropping it down out of the through holes within the clamp to unlock the clamp. There are two pressure gauges on the face of the control panel one being the pressure held within the RCD itself, another being the hydraulic pressure for the cylinders moving the clamps.

In another aspect, a rotating diverter head is disclosed for holding a bearing assembly including an annular bearing body defining a pipe bore, an external sealing flange extending outwardly from the bearing body, and a flexible annular pipe seal attached to the bearing body along the pipe bore. The rotating diverter head comprises a housing having a sidewall defining a cylindrical central bore extending therethrough from an upper end to a lower end along a central axis. The housing includes an external flange extending outwardly from the sidewall at the upper end. The central bore includes a seal bore portion extending axially downward from the upper end, the seal bore portion having a first interior diameter. The sidewall defines an interior shoulder formed axially below the seal bore portion, the central bore having a second diameter at the shoulder, the second diameter at the shoulder being smaller than the first diameter of the seal bore portion. A side outlet extends outwardly from the housing, the side outlet defining an outlet bore extending therethrough along an outlet axis disposed substantially transverse to the central axis, the outlet bore being in fluid communication with the central bore. A bearing adapter ring assembly is dimensioned to be removably insertable into the central bore of the housing through the upper end along the central axis and supported within the seal bore portion of the central bore on the interior shoulder. The bearing adapter ring assembly comprises an upper bearing adapter ring having an upper bearing passage and a downward facing interior upper shoulder, wherein the upper bearing passage is dimensioned to allow passage therethrough of an upper portion of a bearing body of a bearing assembly, and the upper shoulder is dimensioned to bear against an upper side of a sealing flange of the bearing assembly and to form an upper pressure seal between the bearing assembly and the bearing adapter ring assembly when an upper axial seal is present between the opposing surfaces of the upper shoulder and the sealing flange. A lower bearing adapter ring is removably connectable to the upper bearing adapter ring, the lower bearing adapter ring having a lower bearing passage and an upward facing interior lower shoulder, wherein the lower bearing passage is dimensioned to allow passage therethrough of a lower portion of the bearing body, and the lower shoulder is dimensioned to bear against a lower side of the sealing flange and to form a lower pressure seal between the bearing assembly and the bearing adapter ring assembly when a lower axial seal is present between the opposing surfaces of the lower shoulder and the sealing flange. A radial seal is mounted to an radially outward exterior surface of one of the upper and lower bearing adapter rings and dimensioned to bear against the sealing bore portion of the central bore to form an outer pressure seal between the housing and the bearing adapter ring assembly when the bearing adapter ring assembly is within the seal bore portion of the central bore. A clamp mechanism is mounted on the housing and selectively movable between a closed configuration and an open configuration. When the clamp mechanism is in the closed configuration, the clamp assembly engages the external flange of the housing and blocks the bearing adapter ring assembly from moving out of the central bore of the housing along the central axis. When the clamp mechanism is in the open configuration, the clamp assembly does not block the bearing adapter ring assembly from moving out of the central bore of the housing along the central axis.

In one embodiment thereof, the rotating diverter head further comprises an first API flange connected to the housing at the lower end of the central bore and an a second API flange connected to the side outlet at an outer end of the outlet bore.

In another embodiment thereof, the rotating diverter head further comprises a bearing assembly including an annular bearing body defining a pipe bore, an external sealing flange extending outwardly from the bearing body, and a flexible annular pipe seal attached to the bearing body along the pipe bore. The bearing assembly is mounted within the bearing adapter ring assembly between the upper bearing adapter ring and the lower bearing adapter ring. The bearing adapter ring assembly mounting the bearing assembly is positioned within the central bore of the housing.

In still another embodiment thereof, the rotating diverter head further comprises a plurality of bolts. The plurality of bolts are used to removably connect the lower bearing adapter ring to the upper bearing adapter ring to retain the bearing assembly within the bearing adapter ring assembly.

In yet another embodiment thereof, the clamp mechanism further comprises two clamp segments, each clamp segment having a first end, a second end and a C-shaped cross-section between the first and second ends. The clamp mechanism further comprises two actuators. A first of the two clamp actuators is connected between the respective first ends of the two clamp segments. A second of the two clamp actuators is connected between the respective second ends of the two clamp segments. Each clamp actuator is operable to extend into an extended configuration and to retract into a retracted configuration. Retraction of both clamp actuators causes the two clamp segments to move inward towards one another until the closed configuration is reached wherein the C-shaped cross section of each clamp segment engages the external flange of the housing and a portion of each clamp segment blocks the bearing adapter ring assembly from moving out of the central bore of the housing along the central axis. Extension of the two clamp actuators causes the two clamp segments to move outward away from one another until the open configuration is reached wherein the clamp segments do not block the bearing adapter ring assembly from moving out of the central bore of the housing along the central axis.

In a further embodiment thereof, the clamp mechanism further comprises guide rails attached to the housing, wherein each of the guide rails has a cross-sectional profile that engages one or more of the two clamp segments to allow movement of each of the clamp segments along a one-dimensional path. Retraction of the two clamp actuators causes the two clamp segments to move inward along the guide rails towards one another without pivoting. Extension of the two clamp actuators causes the two clamp segments to move outward along the guide rails away from one another without pivoting.

In a still further embodiment thereof, the clamp mechanism further comprises a respective stop member attached to each respective guide rail. Each respective stop member blocks further outward motion of the respective clamp segment moving along the respective guide rail when the respective clamp segment contacts the respective stop member, thereby preventing overtravel of the respective clamp segment.

In a yet further embodiment thereof, the clamp mechanism further comprises a respective first locking lug attached on the respective first end of each clamp segment, each respective first locking lug defining a respective first locking hole positioned such that center axes of both first locking holes are aligned with a first pin path when the clamp mechanism is in the closed position. A first retention mechanism is attached to the housing, the first retention mechanism comprising a first locking pin and a first pin actuator connected to the first locking pin and operable to move the first locking pin along the first pin path between a first extended configuration and a first retracted configuration. When the clamp mechanism is in the closed configuration, the first pin actuator can move the first locking pin into the first extended configuration so that the first locking pin extends through both first locking holes to lock the clamp segments to one another and prevent the clamp mechanism from moving into the open configuration. When the clamp mechanism is in the closed configuration, the first pin actuator can move the first locking pin into the first retracted configuration so that the first locking pin does not extend through the first locking holes, thereby allowing the clamp mechanism to move into the open configuration.

In another embodiment, the clamp mechanism further comprises a respective second locking lug attached on the respective second end of each clamp segment, each respective second locking lug defining a respective second locking hole positioned such that center axes of both second locking holes are aligned with a second pin path when the clamp mechanism is in the closed configuration. A second retention mechanism is attached to the housing, the second retention mechanism comprising a second locking pin and a second pin actuator connected to the second locking pin and operable to move the second locking pin along the second pin path between an second extended configuration and a second retracted configuration. The second pin actuator moves the second locking pin into the second extended configuration when the first pin actuator moves the first locking pin into the first extended configuration, and moves the second locking pin into the second retracted configuration when the first pin actuator moves the first locking pin onto the first retracted configuration. When the clamp mechanism is in the closed configuration and the first pin actuator moves the first locking pin into the first extended configuration, the second pin actuator moves the second locking pin into the second extended configuration so that the second locking pin extends through both second locking holes, whereby both first ends are locked to one another and both second ends are locked to one another. When the clamp mechanism is in the closed configuration and the first pin actuator moves the first locking pin into the first retracted configuration, the second pin actuator moves the second locking pin into the second retracted configuration, whereby neither the first ends nor the second ends of the clamp segments are locked together.

In still another embodiment, the rotating diverter head further comprises a control panel positioned at a remote location, the remote location being at least a predetermined safe distance from the housing. A first circuit runs from the control panel to the two clamp actuators for simultaneously powering the clamp actuators from the remote location to move the clamp mechanism between the closed configuration and the open configuration. A second circuit runs from the control panel to the first and second pin actuators for simultaneously powering the pin actuators from the remote location to move the first and second locking pins between the extended configuration and the retracted configuration.

In yet another embodiment, the two clamp actuators are hydraulically powered, the first circuit includes one or more hydraulic lines, and a first hydraulic control valve is operatively connected to the first circuit at the remote location for selectively controlling the clamp mechanism between the open and closed configurations. The first and second pin actuators are hydraulically powered, the second circuit includes one or more hydraulic lines, and a second hydraulic control valve is operatively connected to the second circuit for selectively controlling the first and second retention mechanisms between the extended and retracted configurations.

In another aspect, a control system for a rotating diverter head is disclosed, the rotating diverter head having a housing with a central bore passing therethrough, a bearing assembly removably mounted in an upper end of the central bore, and a clamp mechanism mounted on the housing and selectively movable between a closed configuration, wherein the bearing assembly is retained in the central bore by the clamp mechanism, and an open configuration, wherein the bearing assembly is not retained by the clamp mechanism and can be removed from the central bore. The disclosed control system comprises a pair of clamp segments mountable on a housing of a rotating diverter head and movable between a closed configuration and an open configuration. A clamp actuator is mountable on the housing and connected between the pair of clamp segments, the clamp actuator being retractable to move the pair of clamp segments inward towards one another until the closed configuration is reached and being extendable to move the pair of clamp segments outward away from one another until the open configuration is reached. A control panel is disposed at a remote location, the remote location being at least a predetermined safe distance from the housing. A first circuit runs from the control panel to the clamp actuator for powering the clamp actuator from the remote location to move between the closed configuration and the open configuration. A first control device is operably connected to the first circuit at the remote location for selectively controlling the clamp mechanism from the remote location to move between the closed configuration and the open configuration.

In one embodiment, the control system further comprises a first pressure gauge mounted on the control panel and operably connectable to the housing to indicate the gauge pressure within the central bore of the housing.

In another embodiment, the clamp actuator is hydraulically powered and the first circuit is a first hydraulic circuit operably connected to a common hydraulic power source. The control system further comprises a second pressure gauge mounted on the control panel and operably connected to the common hydraulic power source to indicate the gauge pressure provided by the common hydraulic power source.

In still another embodiment, the control system further comprises a retention mechanism mountable to the housing and comprising a locking pin and a pin actuator connected to the locking pin, the pin actuator being operable to move the locking pin between a retracted configuration and an extended configuration, wherein when the clamp mechanism is in the closed configuration and the locking pin is in the extended configuration, the locking pin mechanically locks the clamp mechanism in the closed configuration. A second hydraulic circuit runs from the control panel to the pin actuator for powering the pin actuator from the remote location to move the locking pin between the retracted configuration and the extended configuration. The pin actuator is hydraulically powered and operably connected to the common hydraulic power source. A second activation pressure range of the pin actuator is higher than a first activation pressure range of the clamp actuator. When a hydraulic supply pressure from the common hydraulic power source increases sequentially through the first activation pressure range and then through the second activation pressure range, the clamp actuator will move the clamp mechanism from the open configuration to the closed configuration before the pin actuator moves the locking pin from the retracted configuration to the extended configuration. When the hydraulic supply pressure from the common hydraulic power source decreases sequentially through the second activation pressure range and then through the first activation pressure range, the pin actuator will move the locking pin from the extended configuration to the retracted configuration before the clamp actuator moves the clamp mechanism from the closed configuration to the open configuration.

In yet another embodiment, the control system further comprises a three-way hydraulic valve operably connected to a control lever mounted on the control panel and movable between a CLOSE position, a NEUTRAL position, and an OPEN position. Moving the control lever to the CLOSE position commands the three-way valve to supply hydraulic pressure from the common hydraulic power source to a first end of the clamp actuator to move the clamp mechanism into the closed configuration. Moving the control lever to the OPEN position commands the three-way valve to supply hydraulic pressure from the common hydraulic power source to a second end of the clamp actuator to move the clamp mechanism into the open configuration. Moving the control lever to the NEUTRAL position commands the three-way valve to isolate the common hydraulic power source and maintain a current hydraulic pressure on the clamp actuator.

In a further embodiment, the control system further comprises an OVERRIDE switch mounted on the control panel and operably interconnected with the three-way hydraulic valve. While the OVERRIDE switch is continuously activated, commands from the control lever are implemented by the three-way valve. When the OVERRIDE switch is not activated, commands from the control lever are not implemented and the common hydraulic power source is isolated.

In still another aspect, the disclosure describes a method of operating a rotating diverter head, the rotating diverter head having a housing with a central bore passing therethrough, a bearing assembly removably mounted in an upper end of the central bore, and a clamp mechanism mounted on the housing and selectively movable between a closed configuration, wherein the bearing assembly is retained in the central bore by the clamp mechanism, and an open configuration, wherein the bearing assembly is not retained by the clamp mechanism and can be removed from the central bore. The disclosed method comprises the steps of mounting a pair of clamp segments on a housing of a rotating diverter head, the clamp segments being movable between a closed configuration and an open configuration. Another step is mounting a clamp actuator on the housing and connecting the clamp actuator between the pair of clamp segments, the clamp actuator being retractable to move the pair of clamp segments inward towards one another until the closed configuration is reached and being extendable to move the pair of clamp segments outward away from one another until the open configuration is reached. Another step is providing a control panel disposed at a remote location, the remote location being at least a predetermined safe distance from the housing. Another step is providing a first circuit running from the control panel to the clamp actuator for powering the clamp actuator from the remote location to move the clamp segments between an open configuration and a closed configuration. Another step is mounting a pin actuator on the housing and connecting the pin actuator to a locking pin, the locking pin being extendable along a pin path by the pin actuator, wherein the clamp segments have locking holes which are aligned with one another on the pin path when the clamp segments are in the closed configuration. Another step is providing a second circuit running from the control panel to the pin actuator for powering the pin actuator from the remote location to move the locking pin between a retracted configuration and the extended configuration. Another step is providing a first control device operably connected to the first circuit at the remote location for selectively controlling the clamp actuator to move the clamp segments between the open configuration and the closed configuration and operably connected to the second circuit at the remote location for selectively controlling the pin actuator to move the locking pin between the retracted configuration and the extended configuration. Another step is mounting a control lever on the control panel and operably connecting the control lever to the first control device to command the control device by movement of the control lever. Another step is commanding, using a control lever mounted on the control panel, the first control device to control the pin actuator to move the locking pin into the retracted configuration and subsequently to control the clamp actuator to move the clamp segments into the open configuration. Another step is; removing, when present, a first bearing assembly or first bearing adapter ring assembly from the central bore of the housing along the central axis. Another step is mounting a second bearing assembly in one of the first bearing adapter ring assembly or a second bearing adapter ring assembly. Another step is inserting the one of the first or second bearing ring adapter assembly with mounted second bearing assembly into the central bore of the housing along the central axis when the clamp segments are in the open configuration. Another step is commanding, using the control lever, the first control device to control the clamp actuator to move the clamp segments into the closed configuration and subsequently to control the pin actuator to move the locking pin into the extended configuration through the locking holes on the clamp segments.

In one embodiment, the method further comprise the steps of mounting a first pressure gauge on the control panel and operably connecting the first pressure gauge to the housing to indicate the gauge pressure within the central bore of the housing. Another step is monitoring the gauge pressure on the first pressure gauge before moving the clamp mechanism to the open configuration. Another step is moving the clamp mechanism to the open configuration only when the pressure indicated on the first pressure gauge is at atmospheric pressure.

In another embodiment, the method further comprises the steps of mounting an OVERRIDE switch on the control panel and operably interconnecting the OVERRIDE switch to the first control device. While the OVERRIDE switch is continuously activated, commands received from the control lever are implemented by the first control device. When the OVERRIDE switch is not activated, commands received from the control lever are not implemented.

An example embodiment of the present invention will be described within the following pages, by way of example only, with reference to the accompanying drawings.

BRIEF DESCRIPTION OF THE DRAWINGS

For a more complete understanding, reference is now made to the following description taken in conjunction with the accompanying Drawings in which.

DETAILED DESCRIPTION

Figures 1A, 1B:
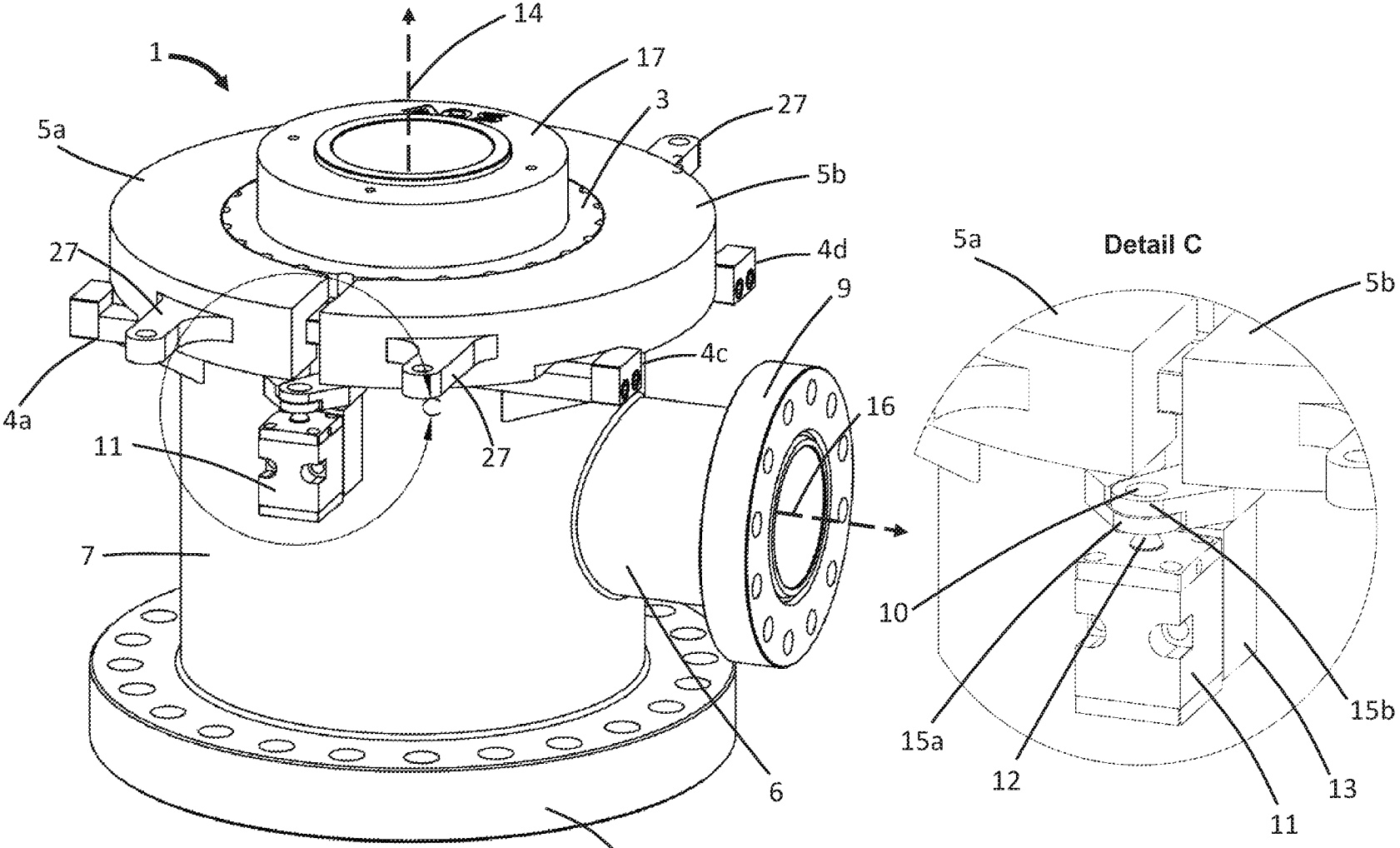
FIG. 1*a* shows an isometric view of the full assembly of the rotating control device according to one embodiment, with the actuation cylinders omitted from the illustration for purposes of clarity.
FIG. 1*b* shows the detail of callout "C" from FIG. 1*a;*

Referring now to the drawings, wherein like reference numbers are used herein to designate like elements throughout, the various views and embodiments of a rotating diverter head with remote controlled clamping system are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring to FIGS. 1*a* and 1*b*, the full assembly of the rotating control device 1 is shown (actuation cylinders for clamps 5*a* and 5*b* are omitted for clarity). The central housing 7 (also known as a "bowl" or "bowl housing") with a protruding side outlet 6 terminating in outlet flange 9. The central housing 7 includes a sidewall 13 (FIG. 2*a*) defining a cylindrical central bore extending therethrough from an upper end to a lower end along a central axis 14. The side outlet 6 defines an outlet bore extending therethrough along an outlet axis 16 disposed substantially transverse to the central axis 14, the outlet bore being in fluid communication with the central bore. The dual actuated clamps 5*a* and 5*b* and remote controlled retention pin mechanism 11 are shown with the clamps in closed position. A second retention mechanism 11 is provided on the opposite side of the housing 7, but cannot be seen in this view. All flanges 8 and 9 on the invention use API (American Petroleum Institution) flange connections allowing for ease of use within industry standards. A bearing assembly 17 is shown in installed position mounted in a bearing adapter ring assembly 3. The clamp halves or segments 5*a* and 5*b* are in the closed position but not locked by the two retention pin mechanisms 11. When the clamp halves are opened by pushing apart, by hydraulic cylinders (not shown) acting on the 4 lugs 27 (one out of view), they are stopped by end stops 4*a* to 4*d* (4*b* is hidden from view). In FIG. 1*b* we see the detail of callout "C" from FIG. 1*a* that shows the locking lugs or grommets 15*a* and 15*b* attached respectively to one end of the clamp halves 5*a* and 5*b*. Each grommet 15*a* and 15*b* defines a locking hole 10. In the closed position shown, the holes 10 align. The locking pin 12 is shown in the retracted position (unlocked). When the locking holes 10 on the respective grommets 15*a* and 15*b* are aligned, the locking pin 12 can be moved to an extended position by the actuator 32 of the retention pin mechanism 11 so that the pin is inserted through both locking holes. The two clamp halves 5*a* and 5*b* can thus be connected together by the extended locking pin 12 so they cannot move apart even if the clamp actuators 25 are activated. The locking pin 12 must be retracted from the locking holes 10 before the clamp halves 5*a* and 5*b* can move apart.

This RCD design features a bearing assembly adapter or bearing adapter ring assembly 3, which adapts a standard bearing assembly 17, with sealing element (e.g., 18), to be usable in different sizes of RCD housing while maintaining a positive seal between the wellbore and atmosphere by utilizing an innovative shell design. This is an inventive feature of this design that enables the same bearing assembly 17 to be assembled with different diameter adapter parts to enable the use with RCDs of different bowl diameters without having to change the core design of the bearing assembly.

Figure 2B:
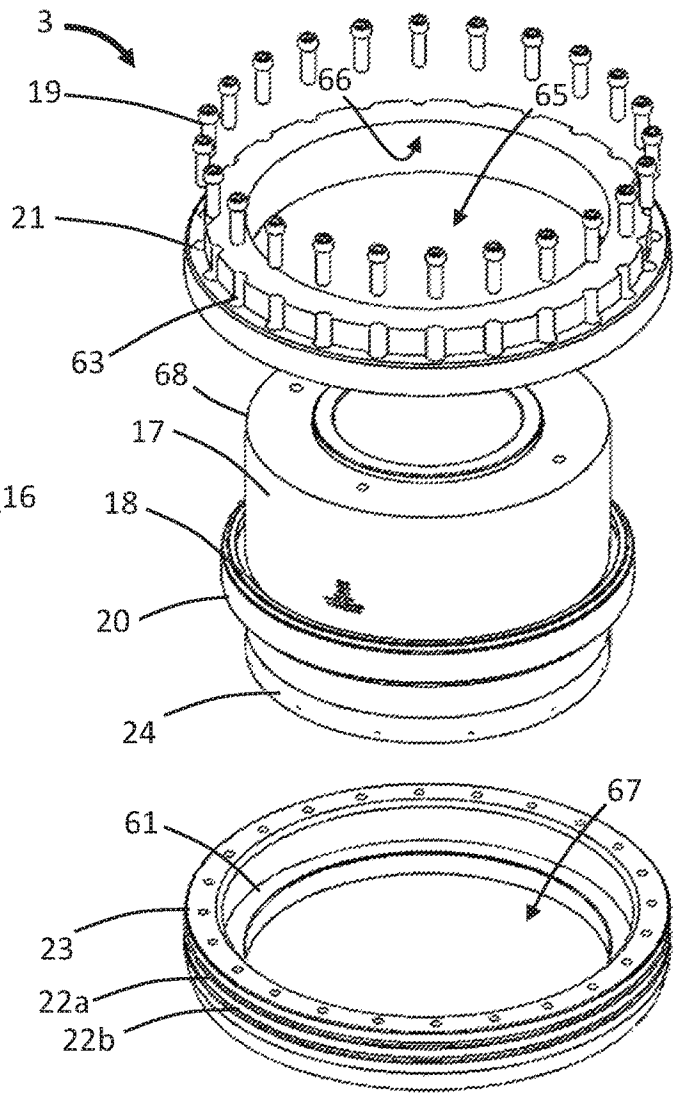
FIG. 2*b* shows an exploded view of the bearing assembly (with the stripper rubber omitted from illustration for purposes of clarity) and the associated bearing adapter ring assembly.
Figure 2A:
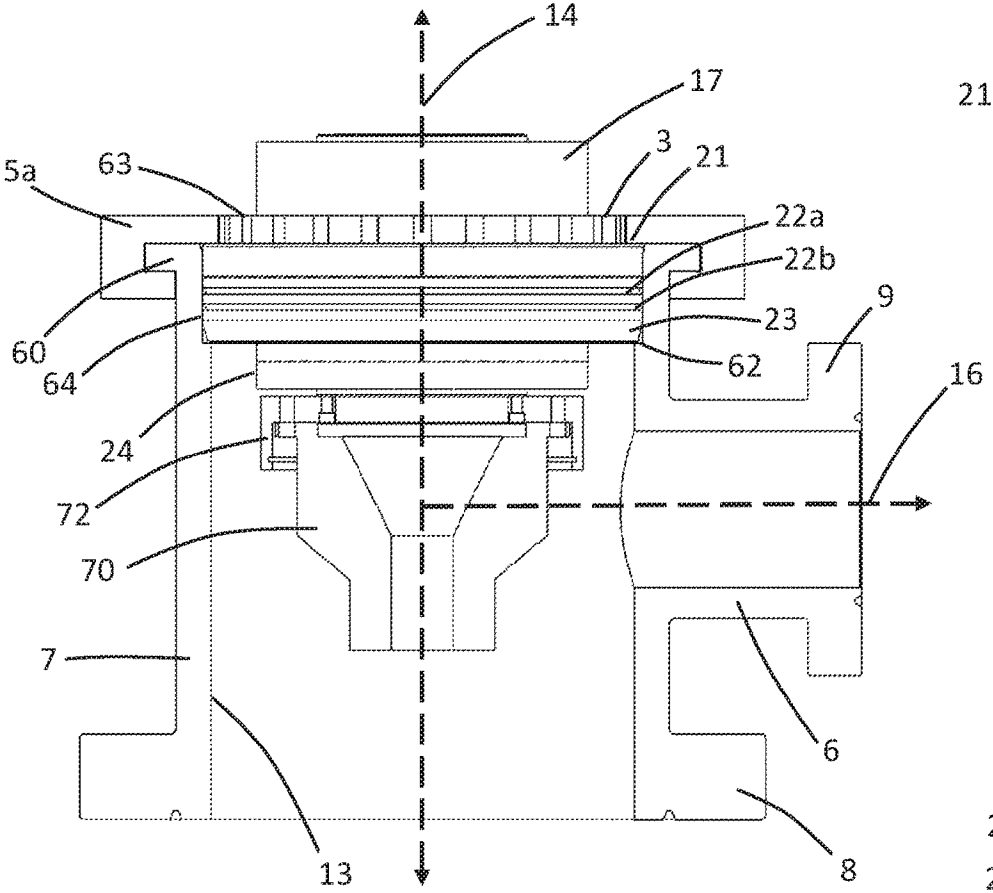
FIG. 2*a* is a mixed schematic view showing the bowl, clamp and stripper rubber assembly in cross section and showing the bearing assembly installed in a bearing adapter ring assembly in a side view (not cross-section)

FIG. 2*a* is a mixed schematic view showing the bowl 7, clamps 5*a* and 5*b* and stripper rubber assembly 70, 72 in cross section and showing the bearing assembly 17 installed in a side view (not cross-section). In FIG. 2*b* there is shown an exploded view of the bearing assembly 17 (with stripper rubber omitted for clarity) and the associated bearing adapter ring assembly 3. The bowl housing 7 can be of different sizes to accommodate different hole sizes that need to be drilled which will dictate the dimensions of flange 8 and therefore the required housing 7 bore. This means that the clamp halves 5*a* and 5*b* will also need to be bigger. Prior art bearing designs ended up with custom sized bearing assemblies to accommodate these dimensional variations resulting in large inventories. The advantageous design will now be explained to address this problem. For purposes of explanation, the bearing assembly 17, which contains the bearings and pressure seals internally (not shown), always stays the exact same dimensions for this design. It is one standard size. The stripper rubber 70 will also have different bore sizes depending on the drill pipe size being used. The attachment interface 72 for all of the different size stripper rubbers 70 will attach to the bottom attachment interface 24 of the bearing assembly 17. In order to install the bearing assembly 17 into different size housings 7, we have a lower ring 23 that has the wellbore seals 22*a* and 22*b* to seal to the housing seal bore 64 inside the housing 7, against wellbore pressure. Then the upper ring 21 bolts to the lower ring 23 with bolts 19, trapping flange 20 on the bearing assembly 17 and sealing with seal 18 to the atmosphere. In this manner the only items to change for reuse of the complete bearing assembly 17 (besides the stripper rubbers) are parts 23 and 21 comprising the bearing adapter ring assembly. This enables a cost effective modular system for different bowl sizes 7. The slots 63 to accommodate the bolts 19 are shown on FIG. 2*a* without the bolts installed.

Referring now to the cross section of the housing 7 in FIG. 2*a*, we can see a shoulder 62 formed in the interior of the central bore by reducing the diameter of the central bore compared to the diameter of the sealing bore portion 64 at the upper end of the central bore. The shoulder 62 supports the ring 23, securing the bearing adapter ring assembly 3 in a fixed position within the sealing bore portion 64 of the central bore of the central housing 7. Then the half clamps or clamp segments 5*a* and 5*b* of the clamp mechanism are closed to secure the top ring 21 of the bearing adapter ring assembly 3 and block upward movement of the bearing ring adapter assembly 3. As illustrated in FIG. 2*a*, the desired bearing assembly 17 can be mounted in the bearing ring adapter assembly 3 between the upper bearing adapter ring 21 and the lower bearing adapter ring 23, which are then connected together with bolts 19 or other fasteners. This traps the bearing assembly 17 and its annular flexible sealing member (e.g., stripper rubber 70) in the bearing ring adapter assembly 3. In the illustrated embodiment, the bearing assembly includes seals 18 on the sealing flange 20 that bear against the upper bearing adapter ring 21 to provide a pressure seal between the bearing assembly and the bearing adapter ring assembly. In other embodiments, one or more seals (e.g., seal 18) can be provided on one of the opposing faces of the upper or lower bearing adapter rings 21, 23 or on the upper or lower surface of the sealing flange 20 of the bearing assembly 17 to provide the pressure seal between the bearing assembly 17 and the bearing adapter ring assembly 3. In the illustrated embodiment, the bearing adapter ring assembly 3 includes seals 22*a* and 22*b* mounted on the lower bearing adapter ring 23 and engaged in the seal bore 64 to provide an outer pressure seal between the bearing adapter ring assembly and the housing 7, thereby completing the pressure isolation of the wellbore from the atmosphere when installed. In other embodiments, one or more outward facing seals (e.g., seals 22*a*, 22*b*) can be mounted on the upper bearing adapter ring 21, lower bearing adapter ring 23 or on the surface of the opposing surface of the seal bore portion 64 of the housing 7 to provide the outer pressure seal between the bearing adapter ring assembly 3 and the housing. In the illustrated embodiment, the clamp mechanism is closed by moving the clamp segments 5*a* and 5*b*, which have C-shaped cross sections, horizontally towards one another to engage the C-shaped cross sections to the flange 60 on the bowl housing 7 and to overlie a rim portion of the bearing adapter ring assembly 3 with portions of the clamp segments to block upward movement of the bearing adapter ring assembly along the central axis 14 and retain the bearing adapter ring assembly (and the bearing assembly 17 mounter therein) within the bore of the housing 7.

Referring now to FIG. 2*b*, an exploded view is shown of the bearing adapter ring assembly 3 and bearing assembly 17. The bearing assembly 17 includes an annular bearing body 68 to which the bearing flange 20 and attachment interface 24 are connected. A stripper rubber 70 of appropriate size can be attached to the attachment interface 24 to serve as a flexible annular pipe seal. The upper bearing adapter ring 21 has an upper bearing passage 65 dimensioned to allow passage therethrough of the upper portion of the bearing assembly 17, and a downward facing interior upper shoulder 66 dimensioned to bear against the upper side of the bearing flange 20. Contact between the bearing flange 20 and the upper shoulder 66 prevents further upward movement of the bearing assembly 17 relative to the upper bearing adapter ring 21. Contact between the bearing flange 20 and the upper shoulder 66 can also provide pressure sealing if seals (e.g., seals 18) are present on one or both opposing surfaces of the flange and shoulder. The lower bearing adapter ring 23 has a lower bearing passage 67 dimensioned to allow passage therethrough of the lower portion of the bearing assembly 17 including the attachment interface 24 and the stripper rubber 70, and an upward facing interior lower shoulder 61 dimensioned to bear against the lower side of the bearing flange 20. Contact between the bearing flange 20 and the lower shoulder 61 prevents further downward movement of the bearing assembly 17 relative to the lower bearing adapter ring 23. Contact between the bearing flange 20 and the lower shoulder 61 can also provide pressure sealing if seals (e.g., seals 18) are present on one or both opposing surfaces of the flange and shoulder. The upper and lower bearing adapter rings 21, 23 can be connected to one another, e.g., with bolts 19, to form the bearing adapter ring assembly 3, thereby trapping the bearing assembly 17 so it cannot move axially (i.e., upwards or downward) relative to the bearing adapter ring assembly.

Referring still to FIG. 2*b*, the bearing adapter ring assembly 3 can further include a seal or seals for sealing against the seal bore portion 64 of the central bore. In the illustrated embodiment, the lower bearing adapter ring 23 includes seals 22*a* and 22*b* for sealing against the seal bore 64. In other embodiments, the seals can be provided on the upper bearing adapter ring 21 instead of the lower bearing adapter ring 23, and in still other embodiments the seals can be provides on both the upper and lower bearing adapter rings. The combination of the seals 22*a* and 22*b* between the sealing bore 64 of the central housing 7 and bearing adapter ring assembly 3, the seals 18 between the bearing adapter ring assembly and the bearing assembly 17, and the flexible seal 70 between the bearing assembly and the pipe (not shown), allows the rotating diverter head to removably secure the bearing assembly while providing a positive seal from the central housing to the pipe, thereby maintaining a pressure seal between the wellbore and the atmosphere.

By providing bearing adapter ring assemblies 3 of different dimensions, a single bearing assembly 17 can be utilized in rotating diverter heads 1 having many differing bowl (i.e., housing) diameters. For most of these situations, only the outer diameter of the upper adapter ring 21 and the lower adapter ring 23 need to be changed to adapt for housings 7 having different diameters. The dimensions of the upper and lower bearing passages 65, 67 and the spacing between the upper and lower shoulders 61, 66 of the bearing adapter ring assembly 3 can remain the same. Alternatively, by providing bearing adapter ring assemblies 3 of different dimensions, a single rotating diverter head 1 can utilize and secure bearing assemblies 17 of many different sizes. For most of these situations, only the diameter of the upper bearing passage 65, the lower bearing passage 67 and/or the spacing between the upper and lower shoulders 66 and 61 need to be changed between the bearing adapter ring assembly 3 for a first bearing assembly 17 and the bearing adapter ring assembly for a second bearing assembly. The outer dimensions of the bearing adapter ring assembly 3 can remain the same. In either case, the fabrication of bearing adapter ring assemblies 3 is relatively simple and inexpensive, especially compared with the trouble and expense of stocking many different sizes of bearing assemblies 17 and housings 7. Therefore, use of the rotating diverter heads of the current invention is economically advantageous.

Figure 3:
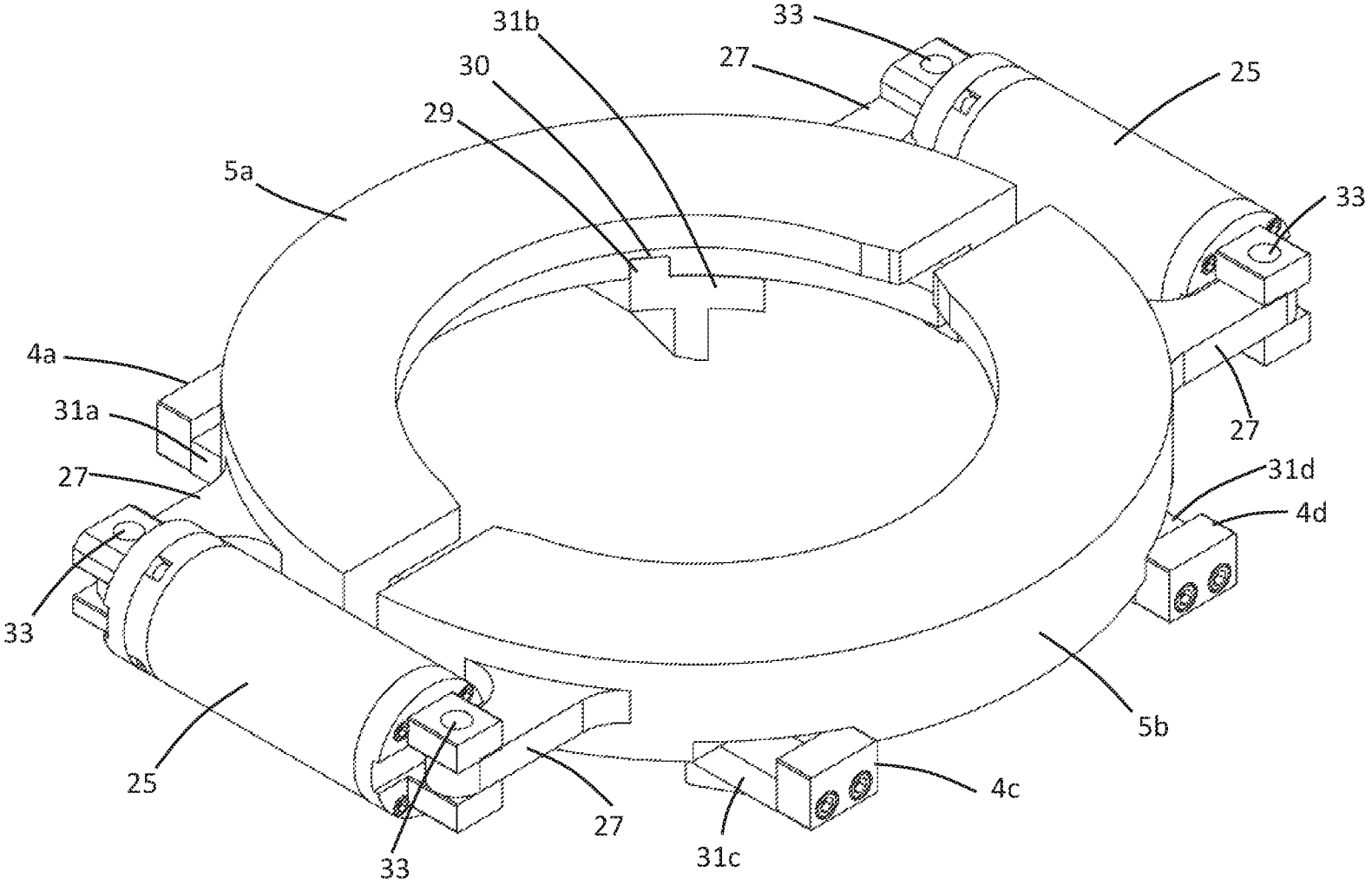
FIG. 3 shows an isometric view the complete clamp assembly with actuation cylinders.

Referring to FIGS. 3 to 5, for the clamping mechanism that is used to connect the bearing assembly 3 to the housing 7 a design is disclosed which uses two half clamps 5*a* and 5*b* with two actuators 25. This type of mechanism allows for smaller clearances and less opening travel requirement resulting in a more robust design compared to the single hinge clamp commonly the used in the prior art rotating head designs. The clamp has an innovative guide track mechanism 31*a* to 31*d* which will be disclosed that ensures equal opening or closing displacement of both clamp segments 5*a* and 5*b* in equal proportion due to the tracks 31 to guide the clamps as they open or close.

In FIG. 3 we show the complete dual clamp assembly with the actuation cylinders 25 and the guide rails 31. The clamp halves 5*a* and 5*b* are sitting on the guide rails 31*a* to 31*d* that are typically welded to the housing 7. All the guide rails have an upstand 29 that locates in the corresponding slots 30 on the clamp halves 5*a* and 5*b*. This constrains the clamp halves to move only in a one-dimensional (i.e., linear motion), horizontal displacement, open and close movement pattern. To open and close the clamp halves 5*a* and 5*b*, the ends of the clamps have attachment eyes 27 to which hydraulic cylinders 25 are attached via pins 33. These hydraulic cylinders 25 are on a common pressure supply from the control panel so that they open and close together in unison. End stops 4*a* to 4*d* ensure that the final opening is equally spaced on the center line of the housing bore. In particular, if the clamp segment 5*a* or 5*b* encounters an end stop 4*a*-4*d* as it moves outward along the respective guide track 31*a*-31*d*, the end stop will block (i.e., stop) further outward movement of that clamp segment, and all further extension of the respective actuator 25 will cause the opposite clamp half to continue to move outward, thereby equalizing the travel of the two clamp halves. The end stops 4*a* to 4*d* also serve to block further outward movement of the clamp segments 5*a* and 5*b* as they are moving outward along their respective guide rails or guide tracks 31*a* to 31*d* to prevent overtravel by any of the clamp segments.

Figure 4A:
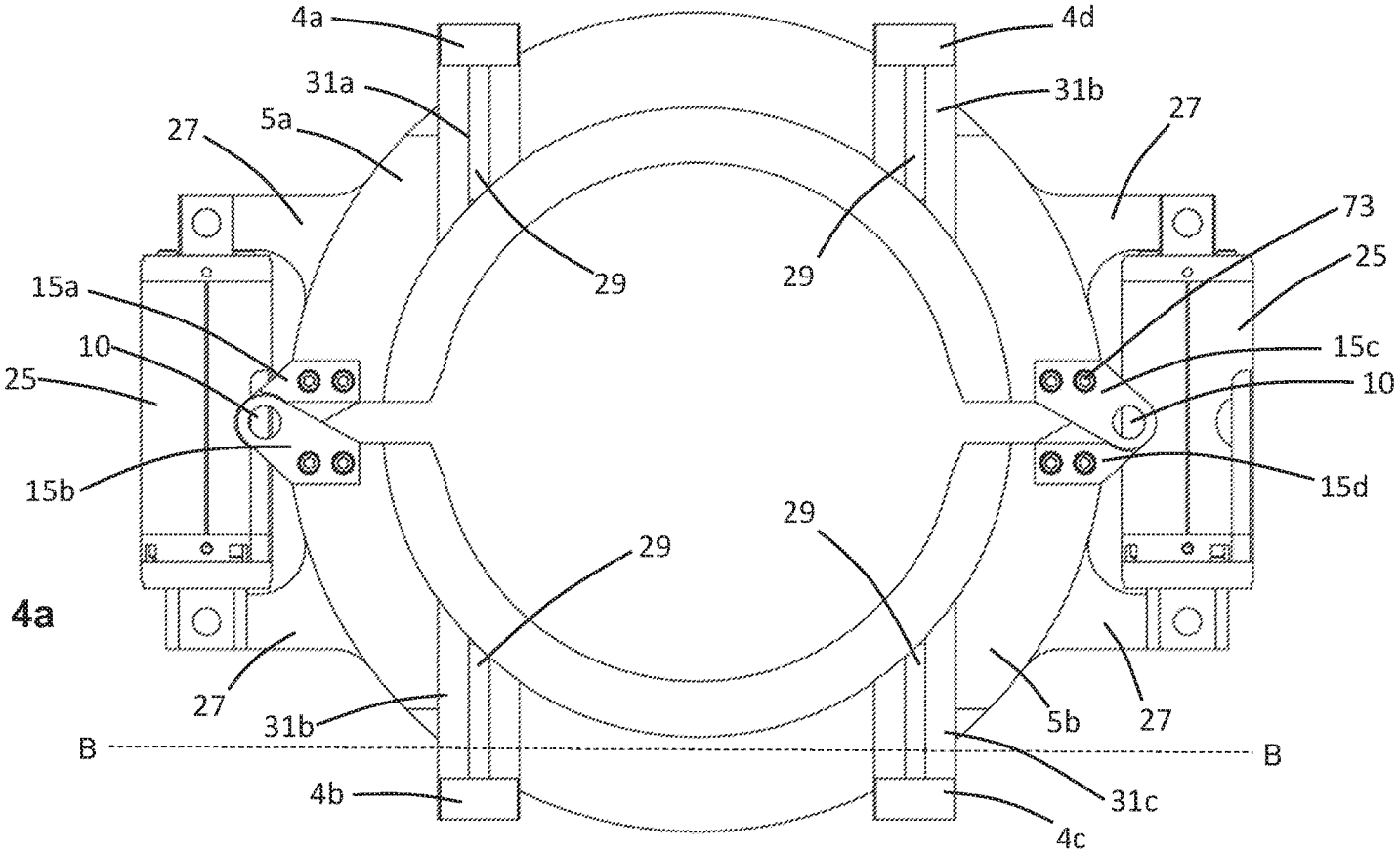
FIG. 4*a* shows a bottom view of the dual actuated clamp in accordance with another aspect.
Figure 4B:
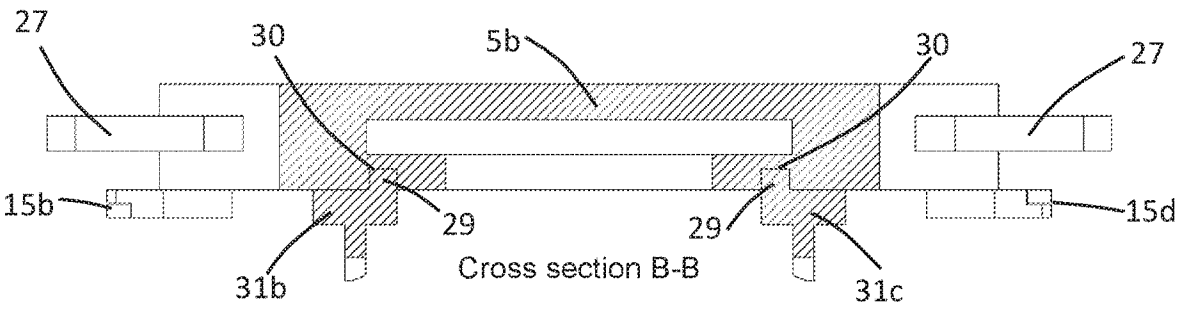
FIG. 4*b* shows the section B-B of FIG. 4*a:*

FIG. 4*a* shows the underside of the dual actuated clamp sitting on the weldable guide rails 31*a* to 31*d*. FIG. 4*b* shows a cross section view along B-B. The locking lugs or grommets 15*a* and 15*b* are attached to the undersides of the clamp halves 5*a* and 5*b* with bolts 73. These drawings are for clarity with no new features introduced. These drawings clarify the guiding functions of the upstands 29 within the slots 30.

Figure 5A:
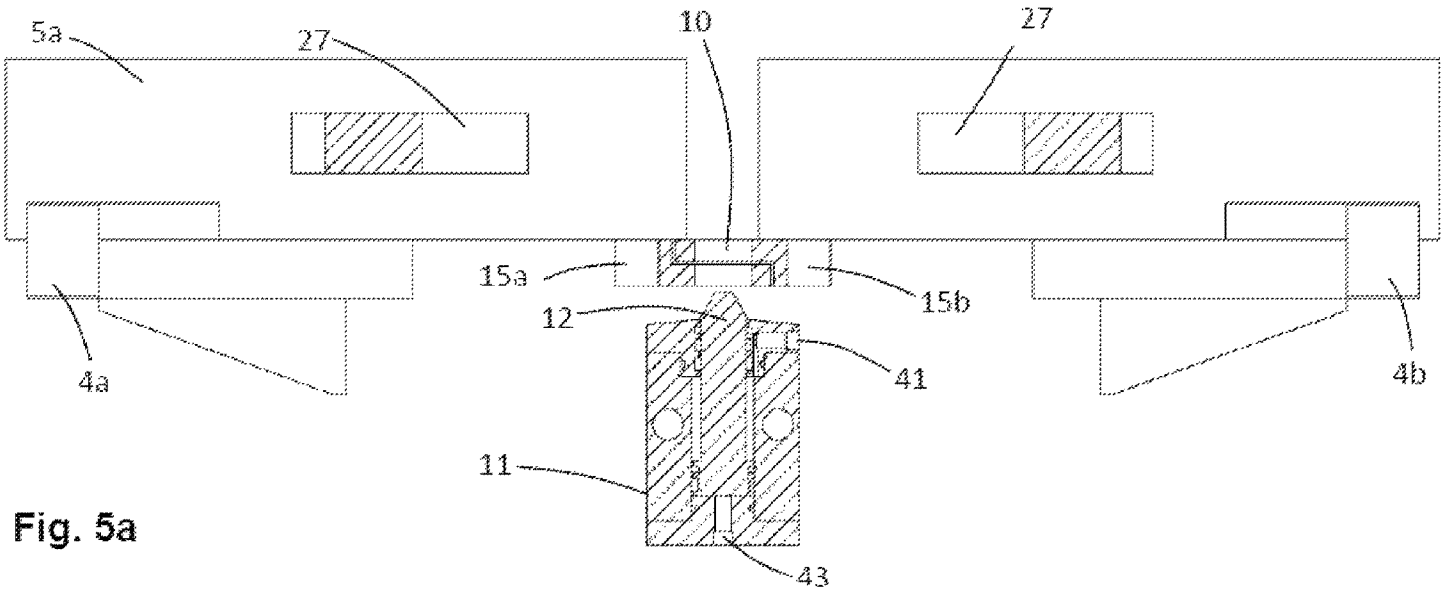
FIG. 5*a* shows a cross section through the middle of the locking pin mechanism and clamp with locking pin in an open position.
Figure 5B:
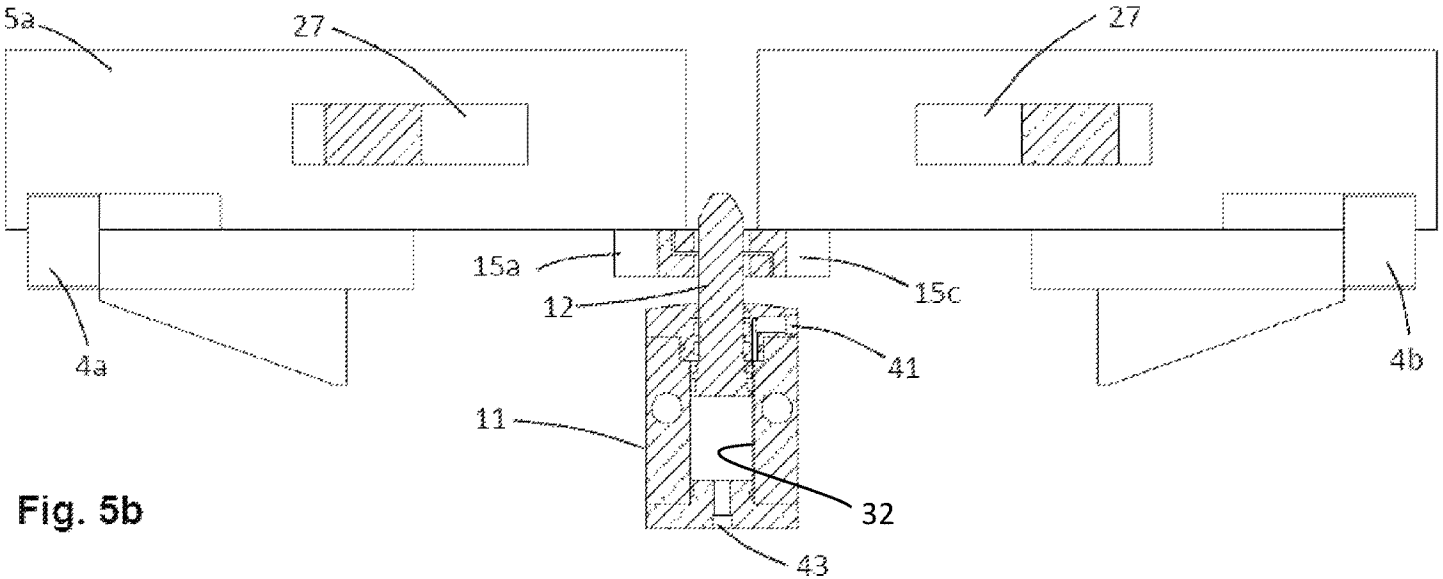
FIG. 5*b* shows a cross section through the middle of the locking pin mechanism and clamp with locking pin in a closed position.

FIG. 5*a* shows a cross section through the middle of the locking pin mechanism 11 and clamp 5*a* with locking pin 12 in an open (i.e., retracted) position. FIG. 5*b* shows the same pin 12 in a closed (i.e., extended) position. The locking pin mechanism is a simple hydraulic cylinder actuated through port 43 for closing pressure and by port 41 for opening pressure. The pin 12 acts as a hydraulic piston inside the actuator 32 of the retention pin mechanism 11 with O-rings (shown but not called out) for pressure isolation.

Figure 6:
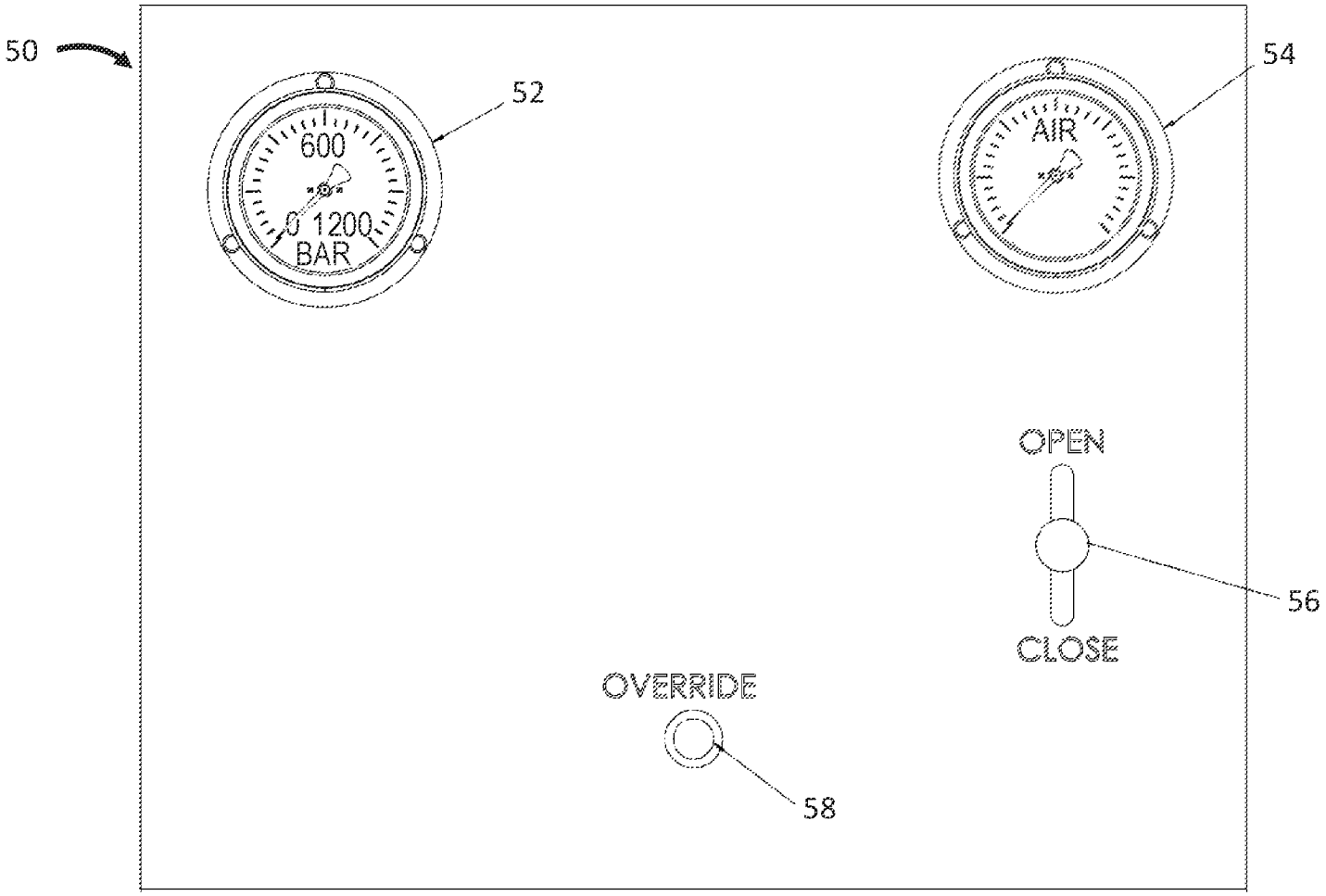
FIG. 6 shows a control panel assembly for remotely controlling the clamp mechanism of the rotating control head in accordance with additional aspects.

Referring now to FIG. 6, the new Dual Actuated Clamp/locking mechanism provides many advantages over previous designs of RCDs (Rotating Control Devices). The fully remote controlled retention pins 12 are operated via a hydraulic control panel 50 at a safe distance away from the RCD assembly itself. This is much safer for the operator to use compared with other prior art designs where the operator had to manually remove/install the safety pins from the clamps, thereby putting themselves at a higher risk for injury or death due to both the high amounts of pressure within the well bore itself, as well as the height at which the RCD is located. Not only is the newly proposed mechanism much safer but also user friendly due to integration of a remote control panel 50.

Referring still to FIG. 6 the remote control panel can have a first pressure gauge 52 mounted thereon. In the illustrated embodiment, the first gauge 52 is operatively connected to the housing 7 to indicate the wellhead pressure within the bore of the housing. This information is important for safety so the operator will not open the clamp mechanism 5*a*, 5*b* when there is any significant pressure inside the housing 7. In other embodiments, the first gauge 52 can indicates the hydraulic clamp pressure available from the pneumatic over hydraulic pump system. This is the hydraulic pressure available to activate the clamps. A second gauge 54 can also be mounted on the control panel 50. In the illustrated embodiment, the second gauge 54 shows the pneumatic input pressure to a small air-driven HPU (hydraulic power unit) situated inside the control panel 50. A control lever 56 can be movably mounted on the control panel 50 and operatively connected to control devices inside the control panel. In the illustrated embodiment, the control lever 56 is operatively connected to a hydraulic three-way valve (not shown since inside control panel 50) that controls the opening and closing of the clamps 5*a* and 5*b*. In the illustrated embodiment, moving the control lever 56 commands the three-way valve to control the clamps 5*a* and 5*b*. In other embodiments, moving the control lever can directly control the three-way valve. With the In the central position, as shown, this isolates the hydraulic supply, and in the open position, supplies hydraulic pressure to the cylinders 25 to open the clamp halves 5*a* and 5*b*. In the illustrated embodiment, the control handle 56 can move between a "Closed" position, an "Open" position, and a "Central" (or "Neutral") position. In other embodiments, other names may be given to the same positions and functions. In the closed position, the control handle 56 commands the control valve to supply hydraulic pressure to the opposite sides of the cylinders 25 to close the clamp halves 5*a* and 5*b*. Further details of the pneumatic-hydraulic panel design are not provided as it is primarily using standard pneumatic-hydraulic design principles.

In accordance with another aspect, a method is disclosed for the remote operation of the rotating diverter head apparatus 1 that provides innovative safety features enabled by this design, including locking pins 12. For the purpose of explaining the method, the initial state of the RCD device is with the clamp halves 5*a* and 5*b* in the open position, so the locking pins 12 of both of the locking pin mechanisms are retracted. The desired bearing assembly 17 is mounted in an appropriately dimensioned bearing adapter ring assembly 3 as previously described, which parts 17 and 3 are together installed in the bore of housing 7 though the upper end of the bore and along the direction of the bore axis 14. The operator (it is assumed) now wishes to close and lock the clamps 5*a*, 5*b*. The operator should first stand in front of the control panel 50, which is remotely located from the housing 7, thus removing the operator from the vicinity of the RCD. The pressure on gauge 52 can be monitored to ensure the pressure in the housing is zero (i.e., atmospheric). Next, the operator must us a first hand to push and hold an override button 58 mounted on the control panel and operatively connected to the three-way valve. In this embodiment, no command or function of the control lever 56 is enabled without holding down the override button 58, so until further notice in this description it is assumed for explanation purposes that the override button 58 is being continuously pressed. The operator can now move the control lever 56 to the "Close" position and (because the button 58 is still activated) this causes the three-way valve to implement the "Close" command received from the control lever to supply hydraulic pressure (e.g., from the HPU) to both cylinders 25, which will begin to retract, closing the clamp.

Once the clamp halves 5*a* and 5*b* are fully closed the hydraulic pressure provided by the hydraulic pressure source will rise, and this can be indicated on the second gauge 54. At this point a second hydraulic valve inside the control panel 50 can be activated by the higher hydraulic pressure to send hydraulic pressure to the pin actuators 32 of the retention pin mechanisms 11 to drive the locking pins 12 into the grommet holes 10, thereby locking the clamp halves. The pressure on gauge 54 will now indicate the maximum hydraulic closing pressure which is a fixed operational pressure of the system. Now the operator can return the control lever 56 to the neutral position, isolating the HPU and locking in the hydraulic pressure for both the retention pin mechanisms 11 and the clamp actuator mechanisms 25 as closed. In some embodiments, once the operator removes his finger from the override button 58, a further safety interlock can be engaged in the hydraulic control panel. If the override button 58 is not pressed down, the control lever 56 cannot be operated (in some embodiments) and/or issues commands that are not implemented by the control valve (in other embodiments), thus preventing accidental opening or closing of the clamps 5*a* and 5*b*.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

It will be appreciated by those skilled in the art having the benefit of this disclosure that this rotating diverter head with remote controlled clamping system provides better functionality, safety and economy than conventional apparatus. It should be understood that the drawings and detailed description herein are to be regarded in an illustrative rather than a restrictive manner and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A rotating diverter head for holding a bearing assembly including an annular bearing body defining a pipe bore, an external sealing flange extending outwardly from the bearing body, and a flexible annular pipe seal attached to the bearing body along the pipe bore, the rotating diverter head comprising:

a housing having a sidewall defining a cylindrical central bore extending therethrough from an upper end to a lower end along a central axis;

wherein the housing includes an external flange extending outwardly from the sidewall at the upper end;

wherein the central bore includes a seal bore portion extending axially downward from the upper end, the seal bore portion having a first interior diameter;

wherein the sidewall defines an interior shoulder formed axially below the seal bore portion, the central bore having a second diameter at the shoulder, the second diameter at the shoulder being smaller than the first diameter of the seal bore portion;

a side outlet extending outwardly from the housing, the side outlet defining an outlet bore extending therethrough along an outlet axis disposed substantially transverse to the central axis, the outlet bore being in fluid communication with the central bore;

a bearing adapter ring assembly dimensioned to be removably insertable into the central bore of the housing through the upper end along the central axis and supported within the seal bore portion of the central bore on the interior shoulder, the bearing adapter ring assembly comprising:

an upper bearing adapter ring having an upper bearing passage and a downward facing interior upper shoulder, wherein the upper bearing passage is dimensioned to allow passage therethrough of an upper portion of a bearing body of a bearing assembly, and the upper shoulder is dimensioned to bear against an upper side of a sealing flange of the bearing assembly and to form an upper pressure seal between the bearing assembly and the bearing adapter ring assembly when an upper axial seal is present between opposing surfaces of the upper shoulder and the sealing flange;

a lower bearing adapter ring that is removably connectable to the upper bearing adapter ring, the lower bearing adapter ring having a lower bearing passage and an upward facing interior lower shoulder, wherein the lower bearing passage is dimensioned to allow passage therethrough of a lower portion of the bearing body, and the lower shoulder is dimensioned to bear against a lower side of the sealing flange and to form a lower pressure seal between the bearing assembly and the bearing adapter ring assembly when a lower axial seal is present between the opposing surfaces of the lower shoulder and the sealing flange; and a radial seal mounted to a radially outward exterior surface of one of the upper and lower bearing adapter rings and dimensioned to bear against the sealing bore portion of the central bore to form an outer pressure seal between the housing and the bearing adapter ring assembly when the bearing adapter ring assembly is within the seal bore portion of the central bore; and a clamp mechanism mounted on the housing and selectively movable between a closed configuration and an open configuration;

wherein when the clamp mechanism is in the closed configuration, a clamp assembly engages the external flange of the housing and blocks the bearing adapter ring assembly from moving out of the central bore of the housing along the central axis; and wherein when the clamp mechanism is in the open configuration, the clamp assembly does not block the bearing adapter ring assembly from moving out of the central bore of the housing along the central axis.

2. A rotating diverter head in accordance with claim 1, further comprising:

a first API flange connected to the housing at the lower end of the central bore; and a second API flange connected to the side outlet at an outer end of the outlet bore.

3. A rotating diverter head in accordance with claim 1, further comprising:

a bearing assembly including an annular bearing body defining a pipe bore, an external sealing flange extending outwardly from the bearing body, and a flexible annular pipe seal attached to the bearing body along the pipe bore;

wherein the bearing assembly is mounted within the bearing adapter ring assembly between the upper bearing adapter ring and the lower bearing adapter ring; and wherein the bearing adapter ring assembly mounting the bearing assembly is positioned within the central bore of the housing.

4. A rotating diverter head in accordance with claim 3, further comprising:

a plurality of bolts; and wherein the plurality of bolts are used to removably connect the lower bearing adapter ring to the upper bearing adapter ring to retain the bearing assembly within the bearing adapter ring assembly.

5. A rotating diverter head in accordance with claim 1, wherein the clamp mechanism further comprises:

two clamp segments, each clamp segment having:

a first end, a second end; and a C-shaped cross-section between the first and second ends;

two clamp actuators, wherein:

a first of the two clamp actuators is connected between the respective first ends of the two clamp segments;

a second of the two clamp actuators is connected between the respective second ends of the two clamp segments; and each clamp actuator is operable to extend into an extended configuration and to retract into a retracted configuration;

wherein retraction of both clamp actuators causes the two clamp segments to move inward towards one another until the closed configuration is reached wherein the C-shaped cross section of each clamp segment engages the external flange of the housing and a portion of each clamp segment blocks the bearing adapter ring assembly from moving out of the central bore of the housing along the central axis; and wherein extension of the two clamp actuators causes the two clamp segments to move outward away from one another until the open configuration is reached wherein the clamp segments do not block the bearing adapter ring assembly from moving out of the central bore of the housing along the central axis.

6. A rotating diverter head in accordance with claim 5, wherein the clamp mechanism further comprises:

guide rails attached to the housing;

wherein each of the guide rails has a cross-sectional profile that engages one or more of the two clamp segments to allow movement of each of the clamp segments along a one-dimensional path;

wherein retraction of the two clamp actuators causes the two clamp segments to move inward along the guide rails towards one another without pivoting; and wherein extension of the two clamp actuators causes the two clamp segments to move outward along the guide rails away from one another without pivoting.

7. A rotating diverter head in accordance with claim 6, wherein the clamp mechanism further comprises:

a respective stop member attached to each respective guide rail;

wherein each respective stop member blocks further outward motion of the respective clamp segment moving along the respective guide rail when the respective clamp segment contacts the respective stop member, thereby preventing overtravel of the respective clamp segment.

8. A rotating diverter head in accordance with claim 5, wherein the clamp mechanism further comprises:

a respective first locking lug attached on the respective first end of each clamp segment, each respective first locking lug defining a respective first locking hole positioned such that center axes of both first locking holes are aligned with a first pin path when the clamp mechanism is in the closed position;

a first retention mechanism attached to the housing, the first retention mechanism comprising:

a first locking pin; and a first pin actuator connected to the first locking pin and operable to move the first locking pin along the first pin path between a first extended configuration and a first retracted configuration;

wherein when the clamp mechanism is in the closed configuration, the first pin actuator can move the first locking pin into the first extended configuration so that the first locking pin extends through both first locking holes to lock the clamp segments to one another and prevent the clamp mechanism from moving into the open configuration; and wherein when the clamp mechanism is in the closed configuration, the first pin actuator can move the first locking pin into the first retracted configuration so that the first locking pin does not extend through the first locking holes, thereby allowing the clamp mechanism to move into the open configuration.

9. A rotating diverter head in accordance with claim 8, wherein the clamp mechanism further comprises:

a respective second locking lug attached on the respective second end of each clamp segment, each respective second locking lug defining a respective second locking hole positioned such that center axes of both second locking holes are aligned with a second pin path when the clamp mechanism is in the closed configuration;

a second retention mechanism attached to the housing, the second retention mechanism comprising:

a second locking pin; and a second pin actuator connected to the second locking pin and operable to move the second locking pin along the second pin path between an second extended configuration and a second retracted configuration, the second pin actuator moving the second locking pin into the second extended configuration when the first pin actuator moves the first locking pin into the first extended configuration, and moving the second locking pin into the second retracted configuration when the first pin actuator moves the first locking pin onto the first retracted configuration;

wherein when the clamp mechanism is in the closed configuration and the first pin actuator moves the first locking pin into the first extended configuration, the second pin actuator moves the second locking pin into the second extended configuration so that the second locking pin extends through both second locking holes, whereby both first ends are locked to one another and both second ends are locked to one another; and wherein when the clamp mechanism is in the closed configuration and the first pin actuator moves the first locking pin into the first retracted configuration, the second pin actuator moves the second locking pin into the second retracted configuration, whereby neither the first ends nor the second ends of the clamp segments are locked together.

10. A rotating diverter head in accordance with claim 9, further comprising:

a control panel positioned at a remote location, the remote location being at least a predetermined safe distance from the housing;

a first circuit running from the control panel to the two clamp actuators for powering the clamp actuators from the remote location to move the clamp mechanism from the open configuration to the closed configuration; and a second circuit running from the control panel to the first and second pin actuators for powering the pin actuators from the remote location to move the first and second locking pins from the retracted configuration to the extended configuration.

11. A rotating diverter head in accordance with claim 10, wherein:

the two clamp actuators are hydraulically powered, the first circuit is a first hydraulic circuit, and a first hydraulic control valve is operatively connected to the first circuit at the remote location for powering the clamp actuators from a common hydraulic power source to selectively control moving the clamp mechanism from the open configuration to the closed configuration using a first predetermined pressure range from the common hydraulic power source;

the first and second pin actuators are hydraulically powered, the second circuit is a second hydraulic circuit, and a second hydraulic control valve is operatively connected to the second circuit at the remote location for powering the pin actuators from the common hydraulic power source to selectively control moving the first and second retention mechanisms from the retracted configuration to the extended configuration using a second predetermined pressure range from the common hydraulic power source, the second predetermined pressure range being higher than the first predetermined pressure range; and wherein when hydraulic supply pressure from the common hydraulic power source increases sequentially through the first predetermined pressure range and then through the second predetermined pressure range, the clamp actuators will move the clamp mechanism from the open configuration to the closed configuration before the pin actuators move the retention mechanisms from the retracted configuration to the extended configuration.

12. A control system for a rotating diverter head, the rotating diverter head having a housing with a central bore passing therethrough, a bearing assembly removably mounted in an upper end of the central bore, and a clamp mechanism mounted on the housing and selectively movable between a closed configuration, wherein the bearing assembly is retained in the central bore by the clamp mechanism, and an open configuration, wherein the bearing assembly is not retained by the clamp mechanism and can be removed from the central bore, the control system comprising:

a pair of clamp segments mountable on a housing of a rotating diverter head and movable between a closed configuration and an open configuration;

a clamp actuator mountable on the housing and connected between the pair of clamp segments, the clamp actuator being retractable to move the pair of clamp segments inward towards one another until the closed configuration is reached and being extendable to move the pair of clamp segments outward away from one another until the open configuration is reached;

a control panel disposed at a remote location, the remote location being at least a predetermined safe distance from the housing;

a first circuit running from the control panel to the clamp actuator for powering the clamp actuator from the remote location to move between the closed configuration and the open configuration; and a first control device operably connected to the first circuit at the remote location for selectively controlling the clamp mechanism from the remote location to move between the closed configuration and the open configuration;

further comprising a first pressure gauge mounted on the control panel and operably connectable to the housing to indicate the gauge pressure within the central bore of the housing;

wherein, the clamp actuator is hydraulically powered and the first circuit is a first hydraulic circuit operably connected to a common hydraulic power source; and further comprising a second pressure gauge mounted on the control panel and operably connected to the common hydraulic power source to indicate the gauge pressure provided by the common hydraulic power source;

further comprising:

a retention mechanism mountable to the housing and comprising a locking pin and a pin actuator connected to the locking pin, the pin actuator being operable to move the locking pin between a retracted configuration and an extended configuration, wherein when the clamp mechanism is in the closed configuration and the locking pin is in the extended configuration, the locking pin mechanically locks the clamp mechanism in the closed configuration;

a second hydraulic circuit running from the control panel to the pin actuator for powering the pin actuator from the remote location to move the locking pin between the retracted configuration and the extended configuration; and wherein the pin actuator is hydraulically powered and operably connected to the common hydraulic power source;

wherein a second activation pressure range of the pin actuator is higher than a first activation pressure range of the clamp actuator;

wherein when a hydraulic supply pressure from the common hydraulic power source increases sequentially through the first activation pressure range and then through the second activation pressure range, the clamp actuator will move the clamp mechanism from the open configuration to the closed configuration before the pin actuator moves the locking pin from the retracted configuration to the extended configuration; and wherein when the hydraulic supply pressure from the common hydraulic power source decreases sequentially through the second activation pressure range and then through the first activation pressure range, the pin actuator will move the locking pin from the extended configuration to the retracted configuration before the clamp actuator moves the clamp mechanism from the closed configuration to the open configuration.

13. A control system for a rotating diverter head in accordance with claim 12, further comprising:

a three-way hydraulic valve operably connected to a control lever mounted on the control panel and movable between a CLOSE position, a NEUTRAL position, and an OPEN position;

wherein moving the control lever to the CLOSE position commands the three-way valve to supply hydraulic pressure from the common hydraulic power source to a first end of the clamp actuator to move the clamp mechanism into the closed configuration;

wherein moving the control lever to the OPEN position commands the three-way valve to supply hydraulic pressure from the common hydraulic power source to a second end of the clamp actuator to move the clamp mechanism into the open configuration; and wherein moving the control lever to the NEUTRAL position commands the three-way valve to isolate the common hydraulic power source and maintain a current hydraulic pressure on the clamp actuator.

14. A control system for a rotating diverter head in accordance with claim 13, further comprising:

an OVERRIDE switch mounted on the control panel and operably interconnected with the three-way hydraulic valve;

wherein while the OVERRIDE switch is continuously activated, commands from the control lever are implemented by the three-way valve; and wherein when the OVERRIDE switch is not activated, commands from the control lever are not implemented and the common hydraulic power source is isolated.

15. A method of operating a rotating diverter head, the rotating diverter head having a housing with a central bore passing therethrough, a bearing assembly removably mounted in an upper end of the central bore, and a clamp mechanism mounted on the housing and selectively movable between a closed configuration, wherein the bearing assembly is retained in the central bore by the clamp mechanism, and an open configuration, wherein the bearing assembly is not retained by the clamp mechanism and can be removed from the central bore, the method comprising the following steps:

mounting a pair of clamp segments on a housing of a rotating diverter head, the clamp segments being movable between a closed configuration and an open configuration;

mounting a clamp actuator on the housing and connecting the clamp actuator between the pair of clamp segments, the clamp actuator being retractable to move the pair of clamp segments inward towards one another until the closed configuration is reached and being extendable to move the pair of clamp segments outward away from one another until the open configuration is reached;

providing a control panel disposed at a remote location, the remote location being at least a predetermined safe distance from the housing;

providing a first circuit running from the control panel to the clamp actuator for powering the clamp actuator from the remote location to move the clamp segments between an open configuration and a closed configuration;

mounting a pin actuator on the housing and connecting the pin actuator to a locking pin, the locking pin being extendable along a pin path by the pin actuator, wherein the clamp segments have locking holes which are aligned with one another on the pin path when the clamp segments are in the closed configuration;

providing a second circuit running from the control panel to the pin actuator for powering the pin actuator from the remote location to move the locking pin between a retracted configuration and an extended configuration;

providing a first control device operably connected to the first circuit at the remote location for selectively controlling the clamp actuator to move the clamp segments between the open configuration and the closed configuration and operably connected to the second circuit at the remote location for selectively controlling the pin actuator to move the locking pin between the retracted configuration and the extended configuration;

mounting a control lever on the control panel and operably connecting the control lever to the first control device to command the control device by movement of the control lever;

commanding, using a control lever mounted on the control panel, the first control device to control the pin actuator to move the locking pin into the retracted configuration and subsequently to control the clamp actuator to move the clamp segments into the open configuration;

removing, when present, a first bearing assembly or first bearing adapter ring assembly from the central bore of the housing along a central axis;

mounting a second bearing assembly in one of the first bearing adapter ring assembly or a second bearing adapter ring assembly;

inserting the one of the first or second bearing ring adapter assembly with mounted second bearing assembly into the central bore of the housing along the central axis when the clamp segments are in the open configuration; and commanding, using the control lever, the first control device to control the clamp actuator to move the clamp segments into the closed configuration and subsequently to control the pin actuator to move the locking pin into the extended configuration through the locking holes on the clamp segments.

16. A method of operating a rotating diverter head in accordance with claim 15, further comprising:

mounting a first pressure gauge on the control panel;

operably connecting the first pressure gauge to the housing to indicate the gauge pressure within the central bore of the housing;

monitoring the gauge pressure on the first pressure gauge before moving the clamp mechanism to the open configuration; and moving the clamp mechanism to the open configuration only when the pressure indicated on the first pressure gauge is at atmospheric pressure.

17. A method of operating a rotating diverter head in accordance with claim 15, further comprising:

mounting an OVERRIDE switch on the control panel;

operably interconnecting the OVERRIDE switch to the first control device;

wherein while the OVERRIDE switch is continuously activated, commands received from the control lever are implemented by the first control device; and wherein when the OVERRIDE switch is not activated, commands received from the control lever are not implemented.

* * * * *